US009760109B2

(12) United States Patent
Khan et al.

(10) Patent No.: US 9,760,109 B2
(45) Date of Patent: Sep. 12, 2017

(54) HEV BRAKE PEDAL ASSEMBLY WITH PEDAL RETURN MECHANISM

(71) Applicant: FORD GLOBAL TECHNOLOGIES, LLC, Dearborn, MI (US)

(72) Inventors: Adil Khan, Windsor (CA); Mark Warren Muddiman, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 69 days.

(21) Appl. No.: 13/875,191

(22) Filed: May 1, 2013

(65) Prior Publication Data

US 2014/0326102 A1 Nov. 6, 2014

(51) Int. Cl.

| | |
|---|---|
| ***G05G 1/44*** | (2008.04) |
| ***G05G 5/03*** | (2008.04) |
| ***G05G 5/05*** | (2006.01) |

(52) U.S. Cl.

CPC ..... *G05G 1/44* (2013.01); *G05G 5/03* (2013.01); *G05G 5/05* (2013.01); *Y10T 74/20528* (2015.01)

(58) Field of Classification Search

CPC .... G05G 1/46; G05G 1/30; B60T 7/06; B60T 11/18; Y10T 74/20888; Y10T 74/20528

USPC ..... 74/512, 518, 560; 60/545, 554; 91/369.2; 303/114.1

See application file for complete search history.

(56) References Cited

U.S. PATENT DOCUMENTS

| | | | | |
|---|---|---|---|---|
| 3,302,481 | A * | 2/1967 | Kenrick et al. | 74/512 |
| 3,972,190 | A * | 8/1976 | Sawyer | B60T 7/06 60/551 |
| 4,130,027 | A * | 12/1978 | Leighton | B60T 7/06 267/153 |
| 6,164,184 | A * | 12/2000 | Kobayashi et al. | 91/376 R |
| 7,367,187 | B2 * | 5/2008 | Ikeda et al. | 60/545 |
| 8,607,660 | B2 * | 12/2013 | Khan et al. | 74/512 |
| 2011/0126665 | A1 * | 6/2011 | Khan et al. | 74/560 |

FOREIGN PATENT DOCUMENTS

| | | | | |
|---|---|---|---|---|
| DE | 102011003510 | A1 * | 12/2011 | B60T 11/18 |

* cited by examiner

*Primary Examiner* — Thomas C Diaz
(74) *Attorney, Agent, or Firm* — David Kelley, Esq.; Tung & Associates

(57) ABSTRACT

A brake pedal assembly includes an assembly frame, a pedal arm pivotally carried by the assembly frame, a booster input rod, a booster washer carried by the booster input rod, a rod actuating element carried by the pedal arm and engaging the booster input rod and a biasing device interposed between the booster washer and the rod actuating element.

8 Claims, 2 Drawing Sheets

HEV BRAKE PEDAL ASSEMBLY WITH PEDAL RETURN MECHANISM

FIELD

Illustrative embodiments of the disclosure generally relate to brake pedals for BBW (Brake By Wire) systems in vehicles. More particularly, illustrative embodiments of the disclosure relate to aBBW brake pedal assembly with a pedal return mechanism which provides a return force for a brake pedal and maintains hysteresis during return of the pedal to the release position.

BACKGROUND

Conventional brake pedals for HEVs may include a foot-actuated brake pedal which pivotally engages a pedal arm. The pedal arm actuates a booster input rod through a booster washer on the rod. The booster input rod actuates the hydraulic brake booster to effect the friction braking operation of the vehicle. Accordingly, upon depression of the brake pedal from a release position to a braking position, the pedal arm pivots and pushes the booster input rod into the brake booster which applies hydraulic braking to the vehicle wheels.

One or a pair of pedal return springs may return the brake pedal to the release position after braking. A hysteresis mechanism on the brake pedal may provide hysteresis during return of the pedal such that the pedal imparts the feel of the brake pedal of a conventional vehicle braking system. The conventional HEV brake pedal design requires application of the hysteresis while a gap is maintained between the pedal arm and the booster washer on the booster input rod and as the pedal returns to the release position. However, this design may add costs to the design and manufacture of the brake pedal.

Accordingly, an HEV brake pedal assembly with a pedal return mechanism which provides a return force for a brake pedal and maintains hysteresis during return of the pedal to the release position is needed.

SUMMARY

Illustrative embodiments of the disclosure are generally directed to a BBW actuation system. An illustrative embodiment of the brake pedal assembly includes an assembly frame, a pedal arm pivotally carried by the assembly frame, a booster input rod, a booster washer carried by the booster input rod, a rod actuating element carried by the pedal arm and engaged by the booster input rod and a biasing device interposed between the booster washer and the rod actuating element.

Illustrative embodiments of the disclosure are further generally directed to a brake pedal return method. An illustrative embodiment of the brake pedal return method includes inserting a biasing device between a booster washer and a rod actuating element on a booster input rod of a brake pedal assembly.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
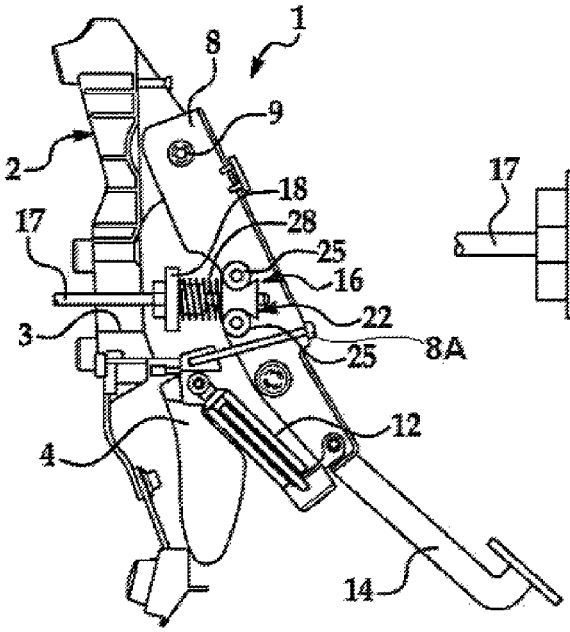
FIG. 1 is a side view of an illustrative embodiment of the BBW brake pedal assembly, with the brake pedal shown in a release position and a pedal return mechanism shown in an expanded position to maintain the brake pedal in the release position.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Referring to FIGS. 1, 1A, 2 and 2A, an illustrative embodiment of the BBW brake pedal assembly, hereinafter assembly, is generally indicated by reference numeral 1. The assembly 1 may include an assembly frame 2 which may be attached to the frame (not shown) of a vehicle using conventional methods. The assembly frame 2 may have a rod opening 3.

A pedal arm 8 may be pivotally attached to the pedal flanges 4 via a pedal arm pivot 9. At least one booster return spring 12 is disposed between the pedal arm 8 and the pedal flange 4. Upon release of the brake pedal 14 from the braking position of FIG. 2, the booster spring 12 along with the biasing spring 28 return the brake pedal 14 back to the release position of FIG. 1 typically in the conventional manner.

A pedal return mechanism 16 may include a booster input rod 17 which operatively engages a hydraulic brake booster (not shown) of the vehicle braking system. The booster input rod 17 may extend through the rod opening 3 in the assembly frame 2. A booster washer 18 may be provided in fixed position on the booster input rod 17. In some embodiments, the booster washer 18 may be threaded on the booster input rod 17.

An hourglass-shaped rod actuating element 22 may be provided on the pedal arm 8. The hourglass-shaped rod actuating element 22 being carried by the pedal arm through a pair of circular-crossectioned pins 25 removably engaging an indented groove in an exterior surface of said hourglass-shaped rod actuating element, seen in FIG. 1A. The booster input rod 17 may freely extend through a pedal opening 22*a* in the rod actuating element 22. The rod actuating element 22 may include a spring engaging surface 23. When the brake pedal 14 is disposed in the release position, as shown in FIGS. 1 and 1A, a gap 30 is defined between the booster washer 18 and the spring engaging surface 23 of the rod actuating element 22.

A biasing device 28 is interposed between surfaces 18*a* of the booster washer 18 and the spring engaging surface 23 of the rod actuating element 22. The biasing device 28 may be any type of biasing mechanism which is suitable for returning the pedal arm 8 to the release position of FIG. 1 when the brake pedal 14 is not depressed. The biasing device 28 may include at least one coiled spring, at least one disk spring or any combination thereof, for example and without limitation.

Figure 1A:
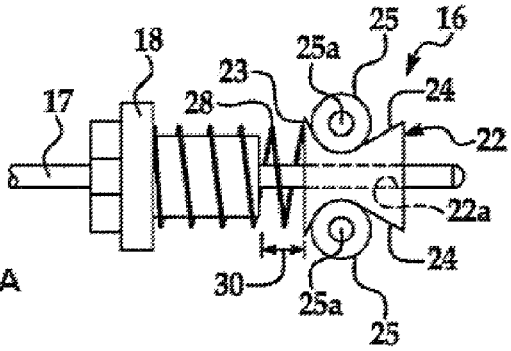
FIG. 1A is an enlarged side view, partially in section, of the pedal return mechanism of the illustrative BBW brake pedal assembly, shown in the expanded position.
Figure 2:
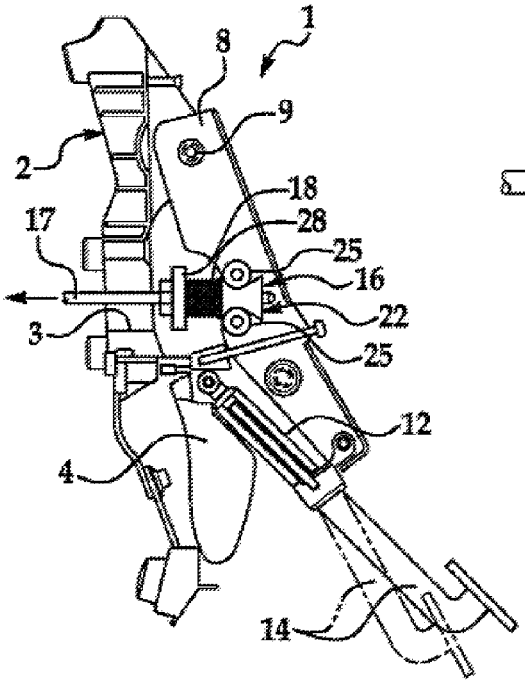
FIG. 2 is a side view of an illustrative embodiment of the HEV brake pedal assembly, with the brake pedal shown in a braking position and the pedal return mechanism shown in a compressed position to actuate a booster input rod. Booster input rod is actuated by washer after gap (30) closure.
Figure 2A:
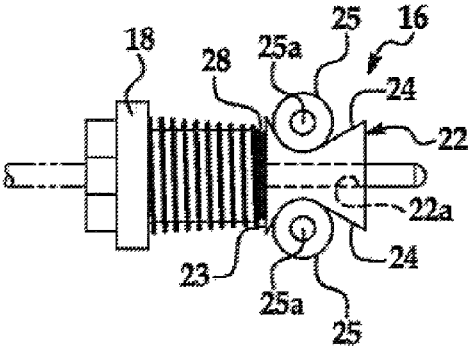
FIG. 2A is an enlarged side view, partially in section, of the pedal return mechanism, shown in the compressed position.

In application of the assembly 1, the biasing device normally pushes the pedal arm 8 in the release position against the upstop bolt 8A as shown in FIG. 1. During braking of the vehicle, the vehicle operator (not shown) applies foot pressure to the brake pedal 14, pivoting the pedal arm 8 at the pedal arm pivot 9. The pedal arm 8 pushes the rod actuating element 22 along the booster input rod 17 toward the stationary booster washer 18, closing the gap 30 as shown in FIGS. 2 and 2A. When the biasing device 28 is maximally compressed between the rod actuating element 22 and the booster washer 18, as illustrated in FIG. 2A, the rod actuating element 22 pushes against the booster washer 18 which, in turn, pushes the booster input rod 17 into the hydraulic brake booster (not shown). The hydraulic brake booster delivers hydraulic pressure to the vehicle brakes (not shown), which apply friction braking to the vehicle wheels such as in the conventional manner.

Upon subsequent release of the brake pedal 14 at the conclusion of friction braking, the biasing device 28 expands and pushes the rod actuating element 22 on the booster input rod 17 away from the booster washer 18. The rod actuating element 22 pivots the pedal arm 8 and the brake pedal 14 back to the release position of FIG. 1 as the gap 30 between the booster washer 18 and the rod actuating element 22 is restored. Simultaneously, responsive to return force applied by the booster/master cylinder assembly (not shown) of the vehicle, the booster input rod 17 withdraws from the brake booster, which terminates friction braking at the vehicle wheels. As the vehicle operator releases the brake pedal 14, the return force of the booster input rod 17 may impart a hysteresis force to the brake pedal 14 via the booster washer 18, the biasing device 28, the rod actuating element 22 and the pedal arm 8. The booster spring or springs 12 may assist in returning the pedal arm 8 and the brake pedal 14 to the release position.

It will be appreciated by those skilled in the art that the pedal return mechanism 16 eliminates the need for a hysteresis mechanism to apply a hysteresis force to the brake pedal 14 as the brake pedal 14 returns to the release position. This expedient may result in cost savings to design and manufacture of the assembly 1. The biasing forces of the biasing device 28 and the booster springs 12 may need to be balanced so that both the return force for the brake pedal 14 is sufficient and the booster washer 18 does not actuate the booster input rod 17 before closure of the gap 30 or completion of the regenerative braking portion of the braking operation. The pedal return mechanism 16 can be retrofitted to existing vehicles by imposition of the biasing device 16 between the booster washer 18 and the rod actuating element 22. The conventional hysteresis mechanism (not shown) can be removed from the brake pedal 14 since the return force exerted by the booster input rod 17 provides a hysteresis force to the brake pedal 14.

Figure 3:
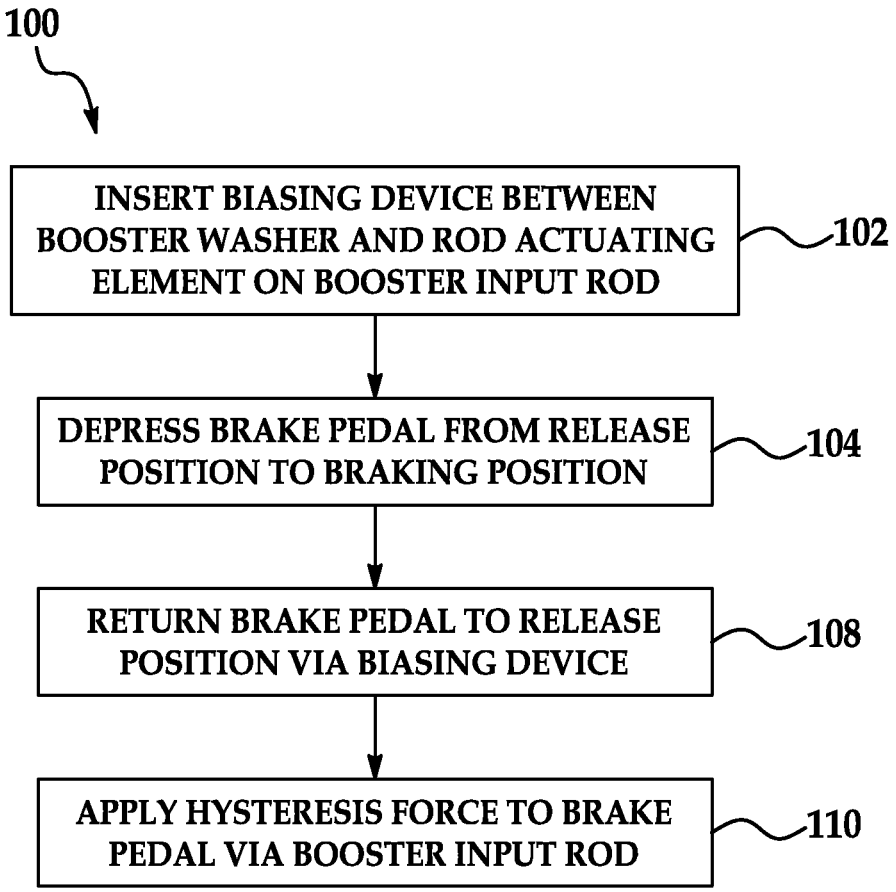
FIG. 3 is a flow diagram of a brake pedal return method.

Referring next to FIG. 3, a flow diagram 100 of a brake pedal return method is shown. In block 102, a biasing device is inserted between a booster washer and a rod actuating element on a booster input rod of a BBW brake pedal assembly. The biasing device may include at least one coiled spring, at least one disk spring or any combination thereof, for example and without limitation. In block 104, the brake pedal is depressed from a release position to a braking position in friction braking of a vehicle. In block 106, the brake pedal returns to the release position via the biasing device. In block 108, upon return of the brake pedal to the brake release position, hysteresis is provided by the booster input rod as the return is damped due to the brake fluid in the master cylinder.

Although the embodiments of this disclosure have been described with respect to certain exemplary embodiments, it is to be understood that the specific embodiments are for purposes of illustration and not limitation, as other variations will occur to those of skill in the art.

What is claimed is:

1. An HEV brake pedal assembly, comprising:

an assembly frame;

a pedal arm pivotally carried by the assembly frame and a pedal upstop disposed on an upper face of the pedal arm;

a booster input rod;

a booster washer fixedly carried by the booster input rod;

an hourglass-shaped rod actuating element carried by the pedal arm through a pair of circular-crossectioned pins removably engaging an indented groove in an exterior surface of said hourglass-shaped rod actuating element and slidably carried by the booster input rod, the booster input rod slidably extending through an opening in the rod actuating element to engage by the pedal arm; and a biasing device interposed to surround the booster input rod between a surface of the booster washer and a surface of the rod actuating element to substantially bridge a gap extending between the booster washer and the rod actuating element, the rod actuating element configured to actuate the booster input rod upon closure of the gap and the biasing device configured to maintain a hysteresis force on the pedal arm during return of the pedal arm to a brake release position, the biasing device further configured to normally bias the pedal arm by pushing the pedal arm against the pedal arm upstop in the brake release position, the pedal arm upstop defining a maximum in pedal arm travel in the brake release position, the booster input rod applying the hysteresis force against the pedal arm.

2. The brake pedal assembly of claim 1 wherein the biasing device comprises at least one spring.

3. The brake pedal assembly of claim 1 further comprising at least one booster spring configured to normally bias the pedal arm and the brake pedal in the brake release position.

4. The brake pedal assembly of claim 1 wherein the booster input rod is configured to apply the hysteresis force against brake pedal via the pedal arm.

5. An HEV brake pedal assembly, comprising:

an assembly frame;

a pedal flange carried by the assembly frame;

a pedal arm pivotally carried by the pedal flange and a pedal upstop disposed on an upper face of the pedal arm;

a brake pedal and the pedal arm pivotal between the brake release position and a braking position;

a booster input rod;

a booster washer fixedly carried by the booster input rod;

an hourglass-shaped rod actuating element carried by the pedal arm through a pair of circular-crossectioned pins removably engaging an indented groove in an exterior surface of said hourglass-shaped rod actuating element and and slidably carried by the booster input rod, the booster input rod slidably extending through an opening in the rod actuating element to engage the pedal arm;

a gap between the booster washer and the rod actuating element when the brake pedal and the pedal arm are disposed in the release position, the gap closed as the brake pedal and the pedal arm pivot from the release position to the braking position; and a biasing device interposed to surround the booster input rod between a surface of the booster washer and a surface of the rod actuating element to substantially bridge a gap extending between the booster washer and the rod actuating element, the rod actuating element configured to actuate the booster input rod upon closure of the gap and the biasing device configured to maintain a hysteresis force on the pedal arm during return of the pedal arm to a brake release position, the biasing device further configured to normally bias the pedal arm by pushing the pedal arm against the pedal arm upstop in the brake release position, the pedal arm upstop defining a maximum in pedal arm travel in the brake release position, the booster input rod applying the hysteresis force against the pedal arm.

6. The brake pedal assembly of claim 5 wherein the biasing device comprises at least one spring.

7. The brake pedal assembly of claim 5 further comprising at least one booster spring configured to normally bias the pedal arm and the brake pedal in the brake.

8. The brake pedal assembly of claim 5 wherein the booster input rod is configured to apply the hysteresis force against the brake pedal via the pedal arm.

* * * * *